US005886720A

United States Patent [19]

Sasaki

[11] Patent Number: 5,886,720

[45] Date of Patent: Mar. 23, 1999

[54] INK CARTRIDGE

[75] Inventor: Toyonori Sasaki, Anjo, Japan

[73] Assignee: Brother Kogyo Kabushiki Kaisha, Nagoya, Japan

[21] Appl. No.: 636,690

[22] Filed: Apr. 23, 1996

[30] Foreign Application Priority Data

Aug. 1, 1995 [JP] Japan ..... 7-216669

[51] Int. Cl.[6] ..... B41J 2/175

[52] U.S. Cl. ..... 347/86

[58] Field of Search ..... 347/86, 87, 49

[56] References Cited

U.S. PATENT DOCUMENTS

| | | | |
|---|---|---|---|
| 4,628,334 | 12/1986 | Dagna et al. . | |
| 4,970,533 | 11/1990 | Saito et al. . | |
| 5,552,816 | 9/1996 | Oda et al. | 347/86 |
| 5,576,749 | 11/1996 | Mochizuki et al. | 347/86 |
| 5,617,128 | 4/1997 | Thoman et al. | 347/87 |
| 5,619,239 | 4/1997 | Kotaki et al. | 347/86 |

FOREIGN PATENT DOCUMENTS

| | | | |
|---|---|---|---|
| 2100977 | 1/1994 | Canada . | |
| 0 585 615 A2 | 3/1994 | European Pat. Off. . | |
| 0 639 462 A2 | 2/1995 | European Pat. Off. . | |
| 0 663 295 A2 | 7/1995 | European Pat. Off. . | |
| 2 440 884 | 6/1980 | France . | |
| 57243 | 3/1988 | Japan | 347/86 |
| 2 017 006 | 9/1979 | United Kingdom . | |
| WO 92/20577 | 11/1992 | WIPO . | |

*Primary Examiner*—Benjamin R. Fuller
*Assistant Examiner*—Craig A. Hallacher
*Attorney, Agent, or Firm*—Oliff & Berridge, PLC

[57] ABSTRACT

Inner wall surfaces of the pair of side walls which are continuously and integrally extended from an opening of an ink tank and confront each other in an ink cartridge have a flat shape. In each side wall, a thickness of a lower portion of the wall is set to be smaller than a thickness of an upper portion. Each cartridge is mounted with the lower portion of the ink tank on a cartridge mount portion between respective partition walls formed on a bottom plate of a head holder. Further, the width of the upper portion of the cartridge is larger than the width of the lower portion. Therefore, the ink cartridge cannot be mounted on the cartridge mount portion incorrectly.

16 Claims, 10 Drawing Sheets

INK CARTRIDGE

BACKGROUND OF THE INVENTION

1. Field of the Invention

The invention relates to an ink cartridge which is detachably mounted on a head holder which is provided to an ink jet printer. In particular, it relates to an ink cartridge in which the ink volume can be increased while miniaturizing the head holder and the ink cartridge can be prevented from being erroneously mounted on the head holder.

2. Description of Related Art

There have been hitherto proposed various cartridges which are applicable to ink jet printers. Generally in a color printing ink jet printer, four ink cartridges which are independently filled with, for example, four colors of colored ink (black, magenta, yellow, cyan) are mounted on a head holder.

A conventional ink cartridge which is used for this type of ink jet printer will be described with reference to FIG. 13. FIG. 13 is a cross-sectional view showing an ink cartridge mounted on a head holder.

In FIG. 13, the head holder 100 has a pair of side walls 101, and a plurality of partition walls 103 (three partition walls are shown in FIG. 13) are formed on a bottom wall 102 which is formed between the side walls 101. An ink cartridge 104 filled with ink (not shown) is mounted between the respective partition walls 103. Each ink cartridge 104 comprises an ink tank 105 which is designed in a substantially rectangular parallelepiped shape having an opening at the upper portion thereof. A cartridge lid 106 is welded to the peripheral edge of the opening of the ink tank 105 to close the ink tank 105.

The peripheral edge of the ink tank 105 and the carriage lid 106 are generally welded to each other by an ultrasonic welding method and, particularly, the welding surfaces of the ink tank 105 and the cartridge lid 106 are welded to each other by a shear welding method which provides a strong welding force. When the shear welding is performed as described above, the outer side portion of each projection 107 formed on the lower surface of the cartridge lid 106 is welded to the inner side portion of a step portion at the peripheral edge of the opening which is formed in the ink tank 105. Therefore, in consideration of the requirements of shear welding, the thickness of the peripheral edge of the opening in the ink tank 105 must be set to 1.5 mm at a minimum. In view of the above requirement, as is apparent from FIG. 13, the ink tank 105 is designed so that the thickness of each side wall 108 of the pair of confronting side walls 108 is set to 1.5 mm over the whole body.

The conventional ink jet recording apparatus as described above is disclosed in Canadian Patent Application No. 2,100,977 (Japanese Laid-open Patent Publication No. Hei-6-40043).

In the ink cartridge 104 as described above, each side wall 108 of the ink tank 105 is designed to have an uniform thickness over the whole body thereof (1.5 mm). However, the thickness of each side wall 108 is excessively large for a disposable ink cartridge and, thus, it must be further thinned.

Further, with respect to each partition wall 103 formed on the bottom wall 102 of the head holder 100, it is required to keep the thickness of the partition wall 103 to the minimum thickness at which it can be formed, and also it is required to reduce the width of the head holder 100 as much as possible in order to miniaturize a carriage on which the head holder is mounted. Therefore, the width between the respective partition walls 103 is set to substantially a fixed value. Accordingly, when the thickness of each side wall 108 of the ink tank 105 is set to a large value as described above, the volume which can be secured in the ink tank 105 is reduced by the amount corresponding to the thickness, so that the amount of ink stocked in the ink cartridge 104 is reduced. In other words, in order to stock a constant amount of ink into the ink cartridge 104, the ink cartridge 104 must be designed to have a large size. This causes the head holder 100 to be large in size, and thus the carriage is also large in size.

Further, in the ink cartridge 104, an ink supply port 109 is formed at the lower position and an ink supply member, provided with an ink filter at the end face thereof, which serves to supply ink to an ink jet head (not shown in FIG. 13) and is provided to the head holder 100, is inserted into the ink supply port 109. The ink cartridge 104 has the same shape at the upper and lower portion thereof, so that there may be a case where the ink supply member which should be inserted into the ink supply port 109 will oppose a portion of the ink cartridge 104 other than the ink supply port 109, i.e., a wall of the ink tank 105, and the ink supply portion is damaged.

SUMMARY OF THE INVENTION

The invention has been achieved to overcome the above problems of the prior art and it has an object to provide an ink cartridge in which the ink volume can be increased with the miniaturization of a head holder. It also has the object of providing an ink cartridge which can be surely prevented from being erroneously mounted on the head holder.

In order to attain the above objects, an ink cartridge of the invention, which is detachably mounted on a head holder and designed in a substantially rectangular parallelepiped shape, is characterized in that the upper and lower portions of the ink cartridge are designed to be different in width.

In the ink cartridge thus structured, the upper and lower portions are designed to be different in width. Therefore, by designing the ink cartridge so that the one of the upper and lower portions of the ink cartridge which is smaller in width can be mounted between partition walls of the head holder, the width of the other portion of the ink cartridge which is not contacted with the partition walls can be designed to be larger by at least the amount corresponding to the thickness of the partition wall. Accordingly, as compared with the case where the ink cartridge is designed to have the same width over the whole body extending from the upper portion to the lower portion, a larger amount of ink can be stocked in the ink cartridge. In addition, only one of the upper and lower portions of the ink cartridge which is smaller in width can be mounted between the partition walls of the head holder. It is impossible to mount the ink cartridge between the partition walls while the cartridge is turned upside down. Therefore, the ink cartridge can be surely prevented from being erroneously mounted on the head holder.

Further an ink cartridge of the invention has an ink tank which has an opening at either one of the upper and the lower portions and is designed in a substantially rectangular shape, and a lid member, which is adhesively attached to the peripheral edge of the opening, serves to close the ink tank, wherein the width of the ink tank at the portion having the opening is set to be larger than that of the other portion, and a pair of side walls which confront each other in the width direction of the ink tank are designed so as to have a smaller thickness at the portion having the smaller width.

In the ink cartridge thus structured, the pair of side walls which confront each other in the width direction of the ink tank are designed so as to have a smaller thickness at the portion having the smaller width. Therefore, as compared with the case where the ink cartridge is designed to have the same width over the whole body extending from the upper portion to the lower portion, the ink amount to be stocked can be further increased by the amount corresponding to the reduction in thickness of the walls. In addition, the side wall portion in the neighborhood of the peripheral edge of the opening keeps such a sufficient thickness as is adhesively attached to the lid member, so that the lid member and the ink tank can be surely adhesively attached to each other.

Further, an ink cartridge of the invention is characterized in that the inner wall surfaces of a pair of side walls confronting each other in the width direction of the ink tank are designed to be flat.

In the ink cartridge thus structured, the inner wall surfaces of the pair of side walls are designed in a flat shape, so that the ink tank can be easily manufactured at low cost by resin molding or the like and the ink amount to be stocked can be increased without complicating manufacture. Still further, the ink cartridge of the invention is characterized in that the lid member is adhesively attached to the ink tank by shear welding.

In the ink cartridge thus structured, the lid member can be surely adhesively attached to the ink tank by shear welding which can provide the highest adhesive strength in an ultrasonic welding. In addition the side wall whose thickness is sufficient for shear welding is secured at the peripheral edge of the opening of the ink tank to which the lid member adheres. Therefore, the lid member and the ink tank can be firmly bonded into one body and the ink cartridge having large ink volume can be manufactured.

As described above, according to the invention, there can be provided an ink cartridge which can increase the ink volume with concurrent miniaturizing of the head holder and one that can be surely prevented from being erroneously mounted on the head holder.

DETAILED DESCRIPTION OF THE PREFERRED EMBODIMENTS

Figure 1:
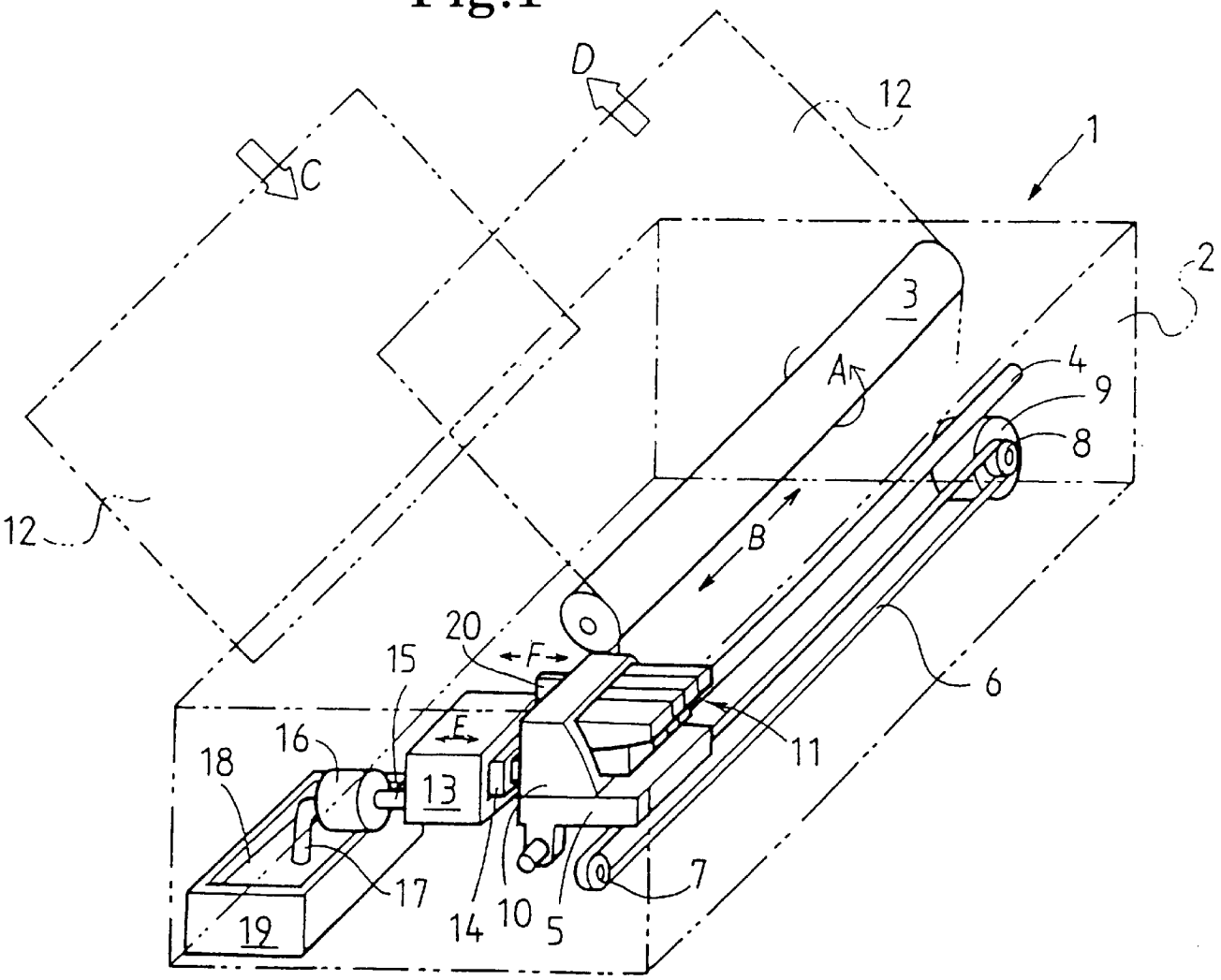
FIG. 1 is a perspective view emphasizing the pertinent features of an ink jet printer.

An ink cartridge according to the invention will be hereunder described in detail with reference to the accompanying drawings. First, the pertinent structure of an ink jet printer to which the ink cartridge of the invention is applied will be described with reference to FIG. 1. As shown in FIG. 1, a platen 3 is provided in a housing 2 so as to be rotatable in the directions indicated by the arrow A. A guide shaft 4 is provided along the platen 3. A carriage 5 is slidably secured to the guide shaft 4 and a belt 6 is secured to the carriage 5. The belt 6 is suspended over an idle pulley 7 and a driving pulley 8. The driving pulley 8 is rotated by a driving motor 9 and upon rotation of the driving pulley 8, the carriage 5 is moved in the directions indicated by arrow B along the guide shaft 4. A head holder 10 is secured on the carriage 5 so as to confront the platen 3 and an ink cartridge 11 is mounted on the head holder 10. An ink jet head 21 (FIG. 5) is secured to the front surface of the head holder 10.

Plural ink channels (not shown) are formed in the ink jet head 21, and a nozzle (not shown) is provided for each ink channel. As described later, ink is supplied from the ink cartridge 11 to the ink jet head 21.

A print sheet 12 is inserted from the rear side of the printer 1 into the housing 2, in the directions indicated by arrow C, and is fed around the platen 3 to exit in the directions indicated by arrow D, and is discharged from the housing 2. When the print sheet 12 is fed to the platen 3, the ink jet head 21 (FIG. 5) which is fixed to the head holder 10 jets ink coordinated with the movement of the carriage 5 to print the desired data.

A cap 13 is provided at a non-print position of the ink jet head 21 at the left side of the platen 3 and a cap rubber 14 is secured to the cap 13 to bring the cap 13 into close contact with the ink jet head 21. The cap 13 is mounted so as to be slidable relatively to the ink jet head 21 in the directions indicated by arrow E. The cap 13 is moved by a moving means (not shown) so that the cap rubber 14 suitably comes into close contact with the ink jet head 21. Further, a link tube 15 is attached between the cap 13 and a pump 16. The pump 16 has a discharge tube 17 exiting therefrom to a waste ink tank 19 in which an adsorbent member 18 is held. A flexible wiper blade 20 is provided between the platen 3 and the cap 13 at the non-print position. The wiper blade 20 is mounted to be slidable in the directions indicated by arrow F. At a normal time the wiper blade 20 is retracted to a backward position to break contact with the ink jet head 21. At a wiping time, the wiper blade 20 is moved to an advanced position so as to come into slidable contact with the ink jet head 21 by the motor (not shown).

Figure 2:
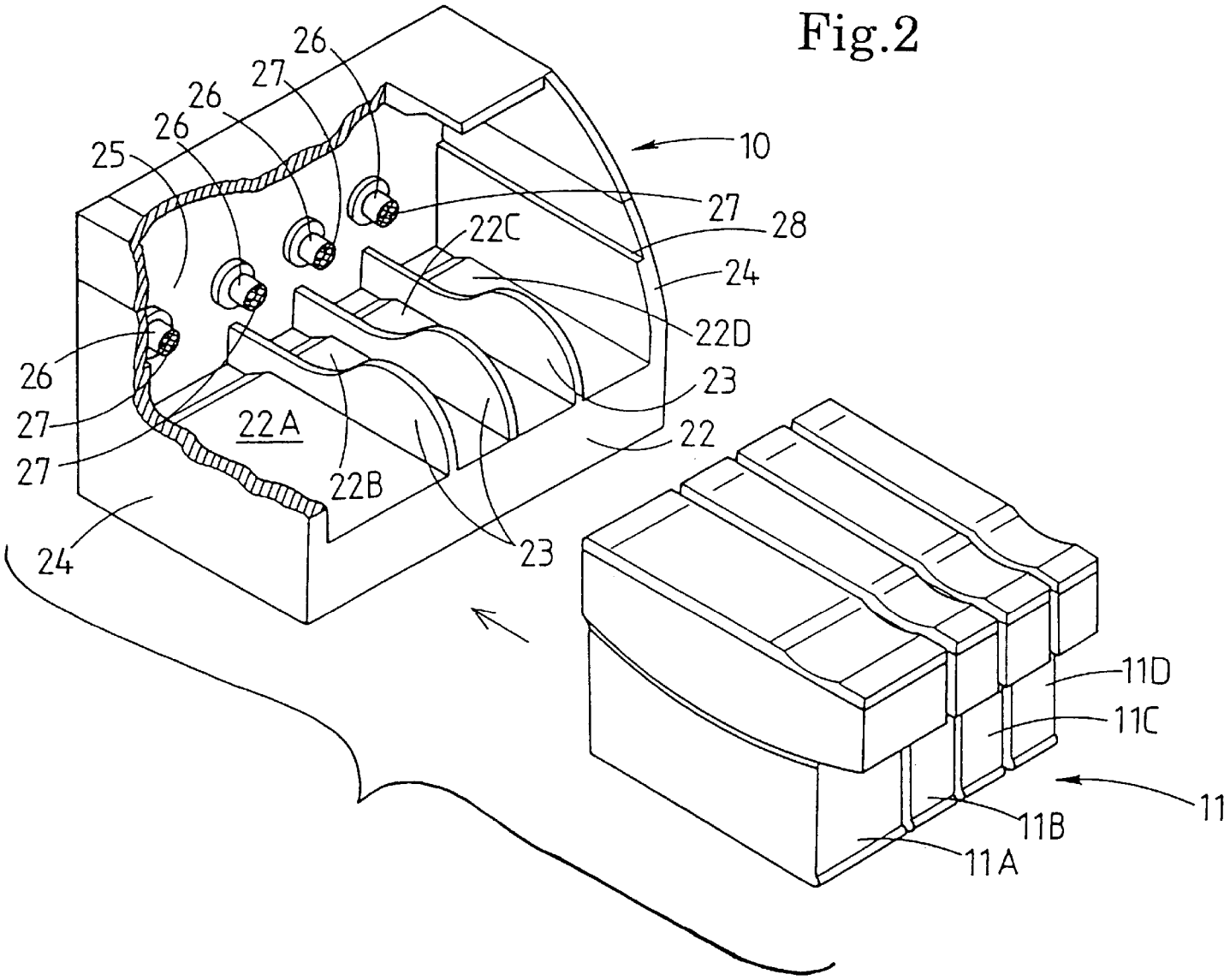
FIG. 2 is a perspective view showing how an ink cartridge is mounted on a head holder.

Next, the link structure between the head holder 10 and the ink cartridge 11 will be described with reference to FIG. 2. FIG. 2 is a perspective view which schematically shows a state where the ink cartridge 11 is to be mounted on the head holder 10.

In FIG. 2, three partition walls 23 are provided on a bottom wall 22 of the head holder 10. The bottom wall 22 is sectioned into four cartridge mount portions 22A, 22B, 22C, 22D through the respective partition walls 23 and between a pair of side walls 24, which are formed at both sides of the bottom wall 22.

Here, the cartridge mount portion 22A is designed to be larger in size than the other three cartridge portions 22B, 22C, 22D. A cartridge 11A filled with black ink in ink cartridges 11 is mounted to the cartridge mount portion 22A. The respective cartridge mount portions 22B, 22C, 22D are designed to have the same size, and the ink cartridges 11B, 11C, 11D, which are filled with cyan ink, magenta ink and yellow ink respectively, are respectively mounted on the cartridge mount portions 22B, 22C, 22D. The cartridge 11A, with the black ink, is designed to have a larger volume than the other cartridges 11B, 11C, 11D filled with the other three colors of ink in consideration of the fact that the frequency of use of black ink is higher than the other colors of ink.

Four ink supply members 26 are secured in correspondence with the respective cartridges 11A–11D on the inner surface side of the front wall 25 of the head holder 10. Each ink supply member 26 serves to feed the ink supplied from the associated ink cartridge 11 to the ink jet head 21 (FIG. 5) which is provided on the outer surface of the front wall 25. A mesh filter 27 is secured to the tip portion of each ink supply member 26. The mesh filter 27 serves to remove dust found in the ink supplied from the ink cartridge 11 and to supply clean ink to the ink jet head 21. A step portion 28 is formed on the inner surface side of each side wall 24 (only the inner surface of one side wall 24 is shown in FIG. 2) so as to be proximately confronted to, and complementary of, the step portion 32 (described later) of the ink cartridges 11A and 11D adjacent thereto.

Figure 3:
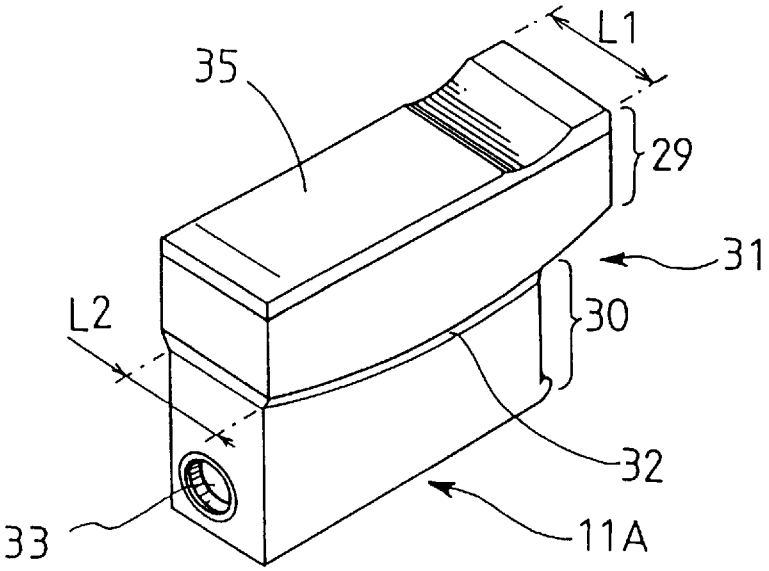
FIG. 3 is a perspective view showing an ink cartridge viewed from the front surface side.
Figure 4:
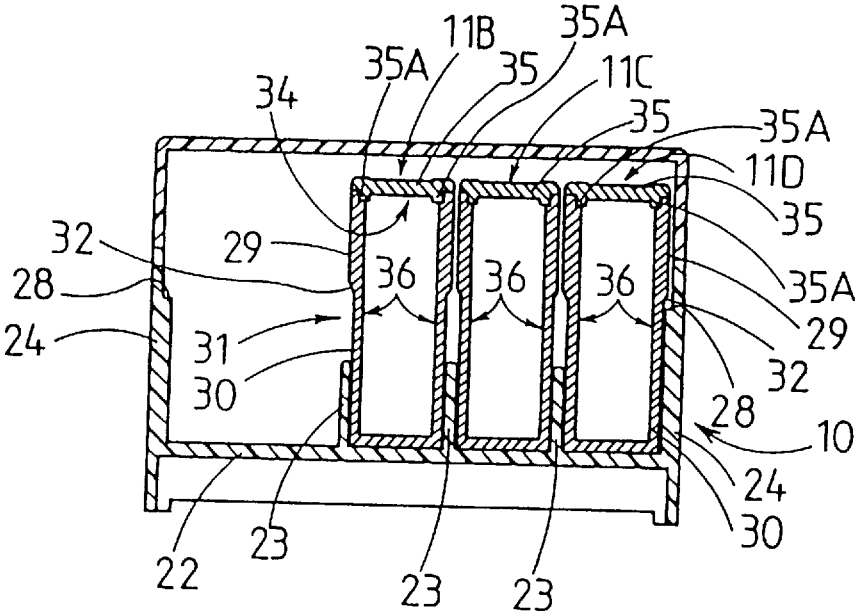
FIG. 4 is a cross-sectional view showing the ink cartridge mounted on the head holder.

Next, the structure of the ink cartridges 11A–11D will be described with reference to FIGS. 3 and 4. FIG. 3 is a perspective view showing the cartridge 11A which is taken from the front side, and FIG. 4 is a cross-sectional view showing ink cartridges 11B–11D which are mounted on the head holder 10. The respective ink cartridges 11A–11D have the same basic structure except that the ink cartridge 11A has a different size from the other three ink cartridges 11B–11D. Therefore, the description with reference to FIG. 3 is made referring to the ink cartridge 11A. Further, in FIG. 4, only the cartridges 11B to 11D are shown.

In FIG. 3, the ink cartridge 11A has two portions of an ink tank 31 comprising an upper portion 29 and a lower portion 30. The width L1 of the upper portion 29 is set to be larger than the width L2 of the lower portion. With this structure, the step portion 32 is formed at the boundary between the upper portion 29 and the lower portion 30. The upper and lower portions 29, 30 may also be described as first and second portions with either one of the upper or lower portion 29, 30 being the first portion and the other of the two portions being the second portion.

An ink supply port 33, into which the ink supply member 26 is engagedly inserted, is provided at the front surface side (left surface side in FIG. 3) of the cartridge 11A. The ink which is impregnated into an ink absorber G (see FIG. 5) housed in the ink cartridge 11A is supplied through the ink supply port 33, the mesh filter 27 and the ink supply member 26 to the ink jet head 21. Further, a cartridge lid (lid member) 35 is welded to the opening 34 in the upper portion 29 (see FIG. 4) by shear welding.

In each ink cartridge 11B–11D, shown in FIG. 4, a pair of side walls 36 which are continuously extended from the opening 34 in the ink tank 31 and confront each other (the lower portion 30 of the side walls 36 are contacted with the respective partition walls 23, and the upper portion 29 and the lower portion 30 thereof are formed integrally) are designed to have flat inner wall surfaces. With this structure, the inner wall surfaces of the upper portion 29 and the lower portion 30 exist on the same plane. Further, the thickness of the upper portion 29 of the side wall 36 is set to 1.5 mm, for example, in consideration of the fact that the inside of the step portion of the opening 34 of the ink tank 31 is welded to the projection 35A formed on the lower surface of the cartridge lid 35 by shear welding. On the other hand, the thickness of the lower portion 30 of the side wall 36 is set to be smaller than that of the upper portion 29 because the lower portion 30 is not directly related to the shear welding. Thus, it is sufficient to be rigid to the extent that it is prevented from being deformed when it is mounted between the partition walls 23 and, for example, the thickness of the lower portion 30 is set to 1.0 mm.

As described above, in each side wall 36, there is a thickness difference of 0.5 mm between the thickness of the upper portion 29 and the thickness of the lower portion 30. Thus, there is a thickness difference of 1.0 m between the width L1 of the upper portion 29 and the width L2 of the lower portion 30 for the two side walls 36.

In the respective ink cartridges 11A–11D of the embodiment thus structured, the width L1 of the upper portion 29 is set to be larger than the width L2 of the lower portion 30, and further the inner wall surfaces of the pair of side walls 36 which are continuously and integrally extended from the opening 34 of the ink tank 31 and confront each other are designed in a flat shape. Further, in each side wall 36, the thickness of the lower portion 30 (1.0 mm) is set to be smaller than the thickness of the upper portion 29 (1.5 mm). Each ink cartridge 11A–11D is mounted at the lower portion 30 of the ink tank 31 on the respective cartridge mount portion 22A–22D between the respective partition walls 23 formed on the bottom plate 22 of the head holder 10. Therefore, the amount of the ink which can be stocked in the ink tank 31 can be increased as compared with the conventional ink cartridge in which the upper and lower portions are designed to have the same width and each side wall of the ink tank is designed to have the same thickness over the whole body from the upper portion to the lower portion. In other words, when a constant amount of ink is filled in each ink cartridge 11A–11D, as compared with the conventional ink cartridge, the ink cartridge 11A–11D can be more miniaturized which enables miniaturization of the head holder 10 and the carriage 5.

Figure 5:
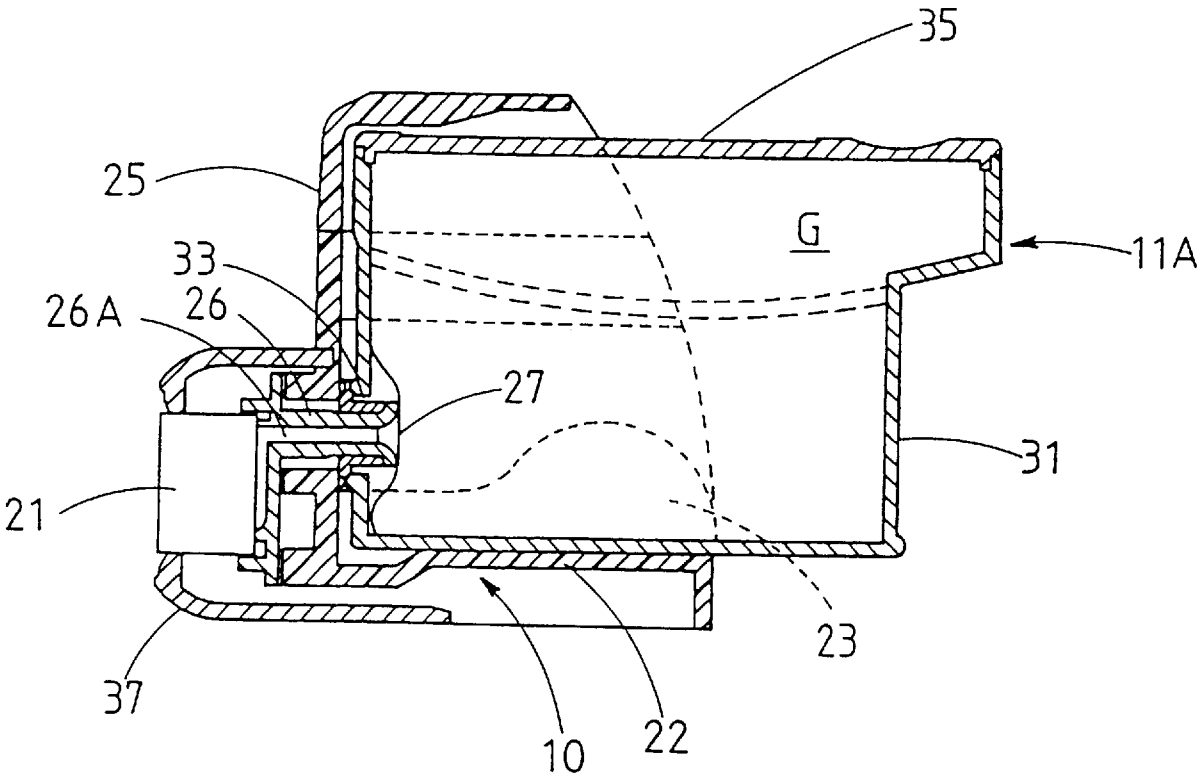
FIG. 5 is a longitudinal sectional view showing the head holder with an ink cartridge mounted on the head holder.

Next, the link structure between each ink cartridge 11A–11D and the ink jet head 21 provided to the head holder 10 will be described with reference to FIG. 5. FIG. 5 is a longitudinally sectional view of the head holder 10, which shows the head holder 10 is mounted with the ink cartridges 11A–11D. In FIG. 5, the ink cartridge 11A is representatively described because the respective ink cartridges 11A–11D have substantially the same structure.

In FIG. 5, the ink cartridge 11A is mounted at the cartridge mount portion 22A between the partition walls 23 on the bottom wall 22 of the head holder 10. An elastic holding member on the carriage (not shown) is suitably engaged with a semi-circular projection which projects from the lower end portion of the rear surface of the ink cartridge 11 A to prevent the rear portion of the ink cartridge 11A from rising up. In this mounted state of the cartridge 11A, the tip portion (right end portion in FIG. 5) of the ink supply member 26 provided on the front surface of the head holder 10 is inserted through the ink supply port 33 of the ink cartridge 11A into the ink cartridge 11A and the mesh filter 27, secured to the ink supply member 26, is pressed against the ink absorber G mounted in the ink cartridge 11A. As a result, the ink absorbed in the ink absorber G is supplied from an ink hole 26A of the ink supply member 26 after dust and other contaminants are removed from the ink by the mesh filter 27. The ink jet head 21 is secured to the front wall 25 of the head holder 10, and a head cover 37 is disposed on the periphery thereof.

When the ink of an ink cartridge 11A thus structured is exhausted, the ink cartridge 11A is exchanged. In this case, in each ink cartridge 11A–11D, the width L1 of the upper portion 29 is set to be larger than the width L2 of the lower portion 30, and the mount width of the cartridge mount portion 22A–22D on which the respective ink cartridge 11A–11D is mounted is set to be substantially equal to the width L2 of the lower portion 29 of the ink cartridge 11. Thus, the mounting direction for each ink cartridge 11 on the corresponding cartridge mount portion 22 is predetermined. However, there may be a case where an operator attempts to mount the ink cartridge 11 on the cartridge mount portion 22 with the top of the cartridge turned down. In this case, since the ink supply port 33 is formed only at a lower side of the front surface of each ink cartridge 11, the upper wall portion on the front surface or the wall portion of the rear surface of the ink cartridge 11 may be brought into contact with the mesh filter 27 secured to the ink supply member 26, so that the mesh filter is damaged. Therefore, it is necessary to effectively prevent this damage.

In the respective ink cartridges 11A–11D of the ink cartridge 11 of this embodiment, the width L1 of the upper portion 29 is set to be larger than the width L2 of the lower portion 30 as described above, whereby the ink cartridges 11 can be prevented from being mounted on the corresponding cartridge mount portions 22 when turned upside down. Here, the structure to prevent the erroneous mounting of the respective ink cartridges 11A–11D will be described with reference to FIGS. 6 and 7.

Figure 6:
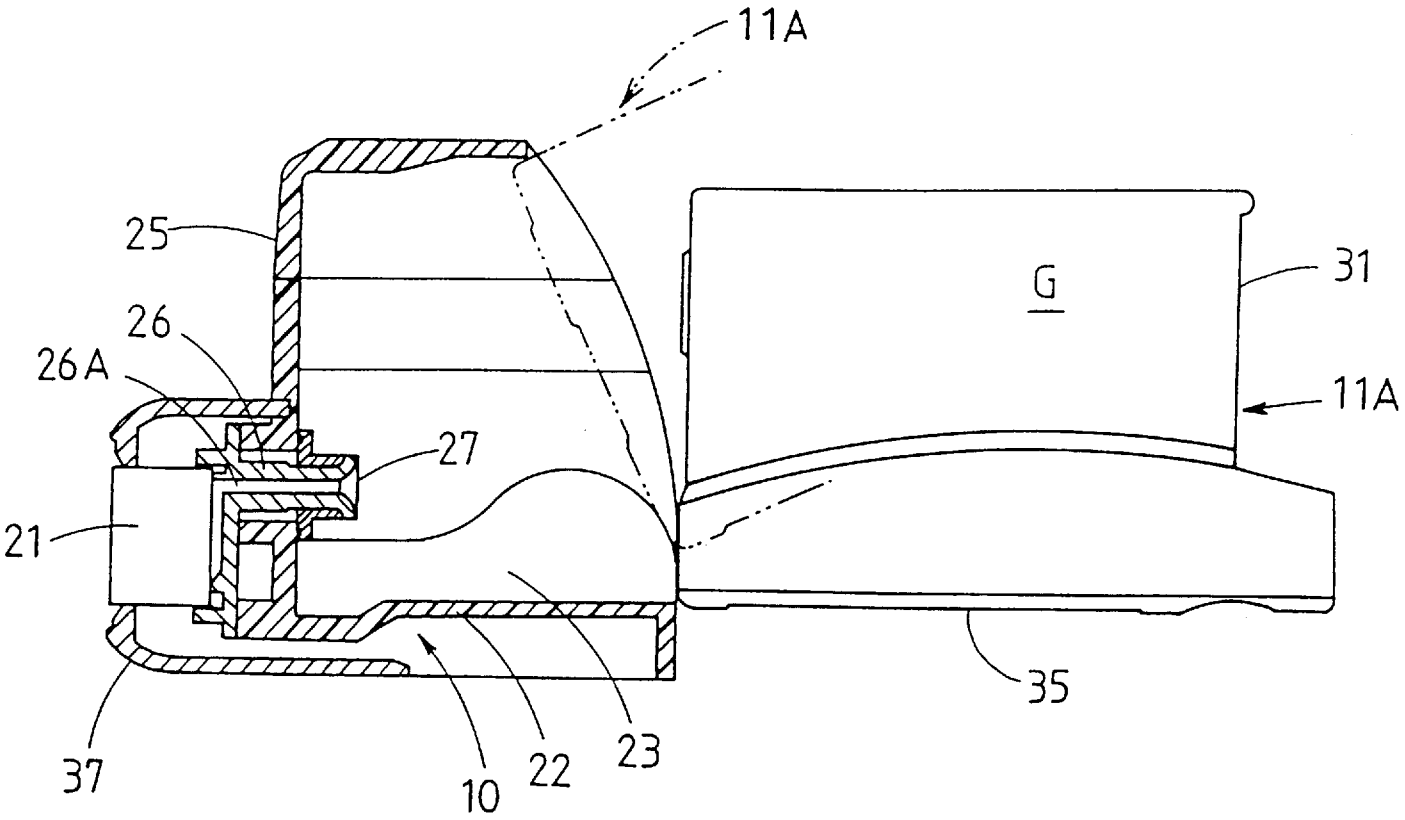
FIG. 6 is a schematic diagram showing an attempted mounting of an ink cartridge on the head holder when upside down.
Figure 7:
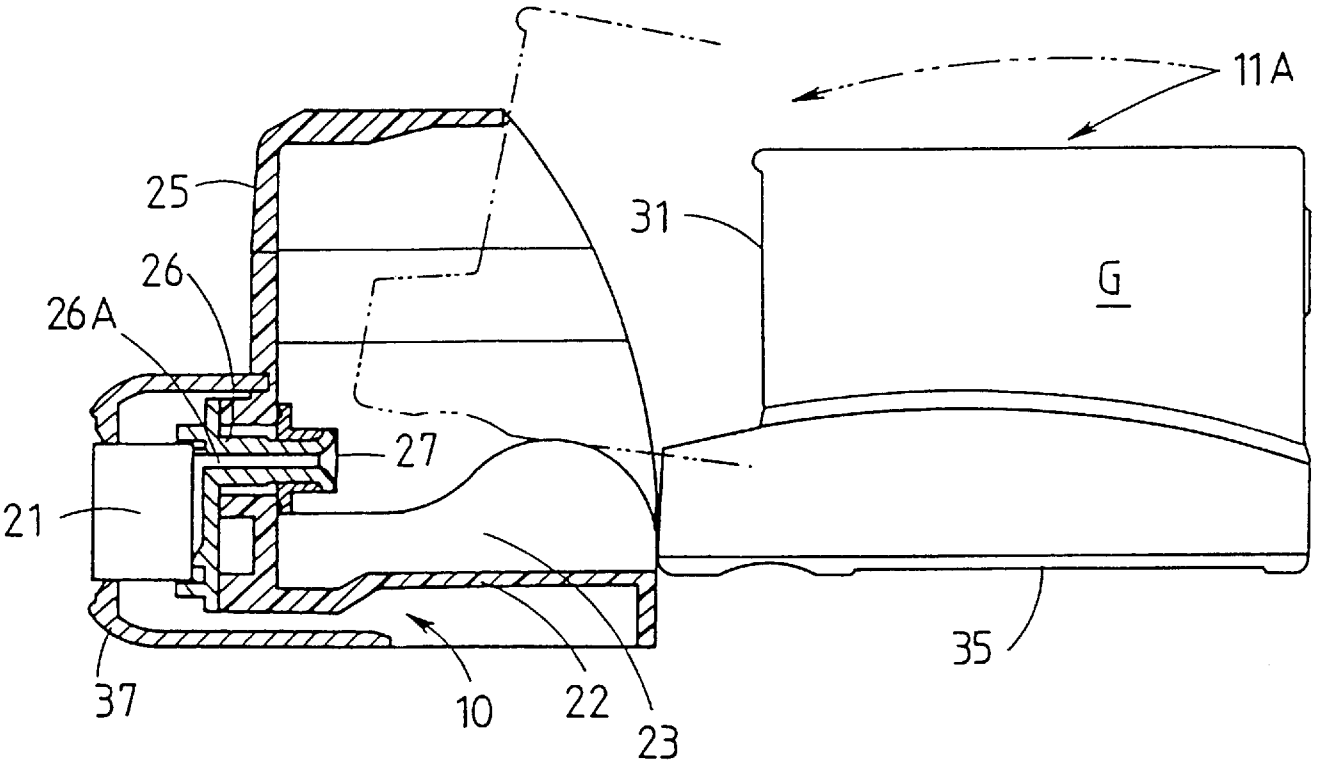
FIG. 7 is a schematic diagram showing an attempted mounting of the ink cartridge on the head holder when upside down and reversed.

FIG. 6 is a schematic diagram showing an attempt to mount the ink cartridge 11A on the cartridge mount portion 22A from the front surface side while the ink cartridge 11A is turned upside down. FIG. 7 is a schematic diagram showing an attempt to mount the ink cartridge 11A on the cartridge mount portion 22A from the rear side and turned upside down. In FIGS. 6 and 7, the ink cartridge 11A is representatively illustrated because the respective cartridges 11A–11D have the same basic structure.

When the ink cartridge 11 is properly mounted on the cartridge mount portion 22, the ink supply member 26 of the head holder 10 is engagedly inserted into the ink supply port 33 of the cartridge 11, as shown in FIG. 5, and presses the ink absorber G, whereby the ink absorbed in the ink absorber G can be supplied from the ink hole 26 to the ink jet head 21. However, for example, when an attempt is made to mount the ink cartridge 11 that is turned upside down, whether forwards or backwards, the ink cartridge 11 cannot be mounted on the mount portion 22 as shown in FIGS. 6 and 7. Therefore, it can be surely prevented that the ink cartridge 11 is not erroneously mounted on the mount portion 22A and the mesh filter 27 damaged.

In the ink cartridge 11 which is described above in detail, the width L1 of the upper portion 29 is set to be larger than the width L2 of the lower portion 30. In addition, the inner wall surfaces of the pair of side walls 36 which are continuously and integrally extended from the opening 34 of the ink tank 31 in each ink cartridge 11 and confront each other are designed to be flat, the thickness of the lower portion 30 in each side wall 36 is set to be smaller than that of the upper portion 29, and each ink cartridge 11 is mounted through the lower portion 30 of the ink tank 31 thereof on the appropriate cartridge mount portion 22 between the partition walls 23 which are formed on the bottom plate 22 of the head holder 10. Therefore, the amount of the ink which can be stocked in the ink tank 31 is increased as compared with the conventional ink cartridge which has the same thickness over the whole body of each side wall from the upper portion to the lower portion on each side wall of the ink tank. In other words, as compared with the conventional ink cartridge, the ink cartridge 11 is miniaturized in order to fill a fixed amount of ink into each ink cartridge 11. This enables the miniaturization of the head holder 10 and the carriage 5.

The ink cartridges 11A–11D of the ink cartridge 11 of this embodiment are designed so that the width L1 of the upper portion 29 is larger than the width L2 of the lower portion 30. Therefore, each of the ink cartridges 11A cannot be improperly mounted on the corresponding cartridge mount portions 22.

The invention is not limited to the above embodiment, and various improvements and modifications may be made without departing from the subject matter of the invention.

Figure 8:
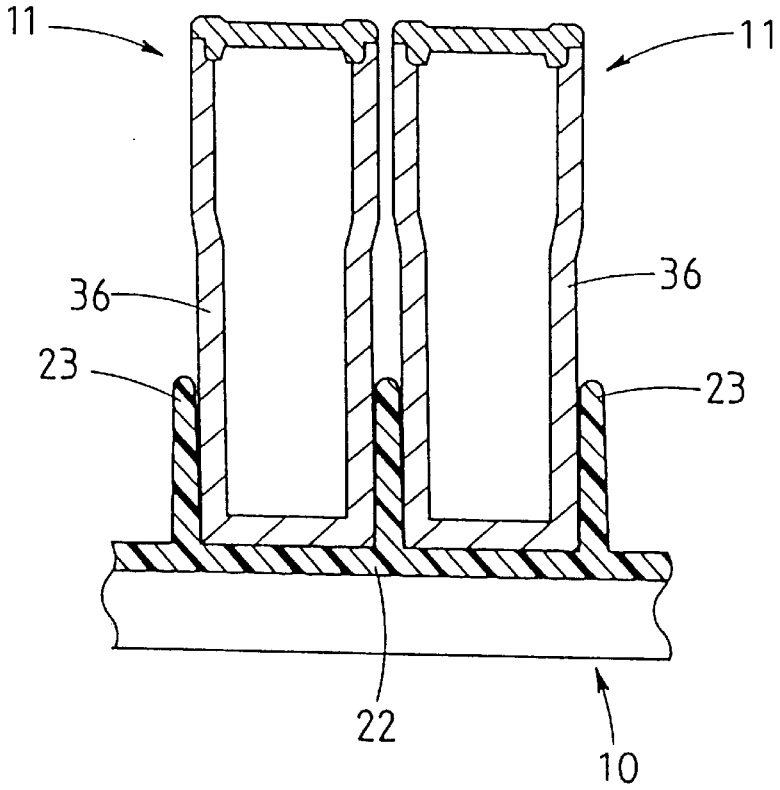
FIG. 8 is a sectional view of the ink cartridge of a second embodiment.

For example, according to a second embodiment shown in FIG. 8, the width L1 of the upper portion may be set to be larger than the width L2 of the lower portion 30 while each side wall 36 of the ink tank 31 is designed so as to have the same thickness over the whole body from the upper portion to the lower portion thereof. In this case, the ink volume is slightly reduced as compared with the first embodiment, however, substantially the same effect can be obtained and the ink cartridge holds more ink than the conventional ink cartridge.

Figure 9:
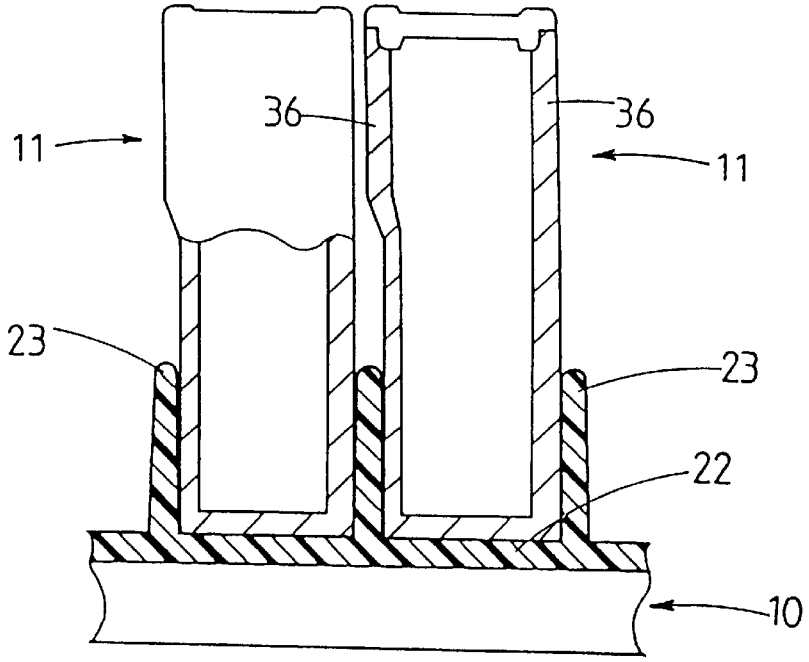
FIG. 9 is a sectional view of the ink cartridge of a third embodiment.

According to a third embodiment, shown in FIG. 9, one side wall of the side walls 36 of the ink tank 11 is kept flat while a step portion is formed only in the other side wall whereby the width L1 of the upper portion 29 is set to be larger than the width L2 of the lower portion 30.

Figure 10:
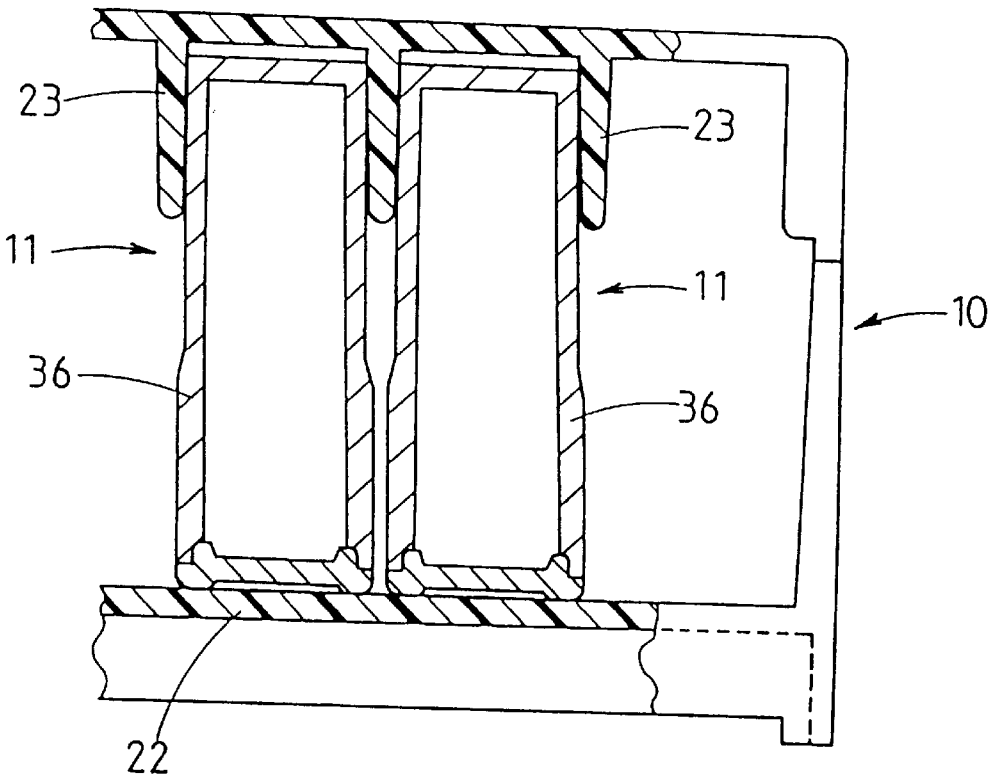
FIG. 10 is a sectional view of the ink cartridge of a fourth embodiment.

Further, according to a fourth embodiment, shown in FIG. 10, the partition walls 23 may be formed on the upper wall portion of the head holder 10. In this case, the width of the lower portion of each ink cartridge 11 is set to be larger than the width of the upper portion, whereby the same effect as the above embodiment can be obtained.

Figure 11:
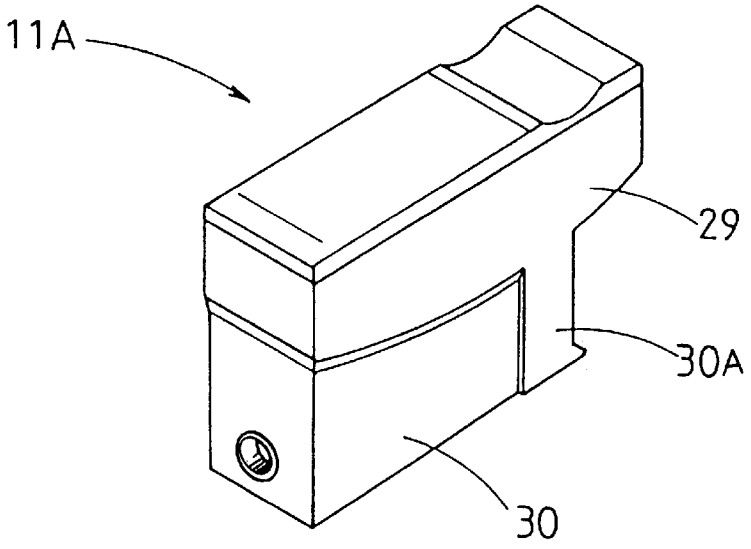
FIG. 11 is a perspective view of the cartridge of a fifth embodiment of the ink cartridge taken from its front surface side.
Figure 12:
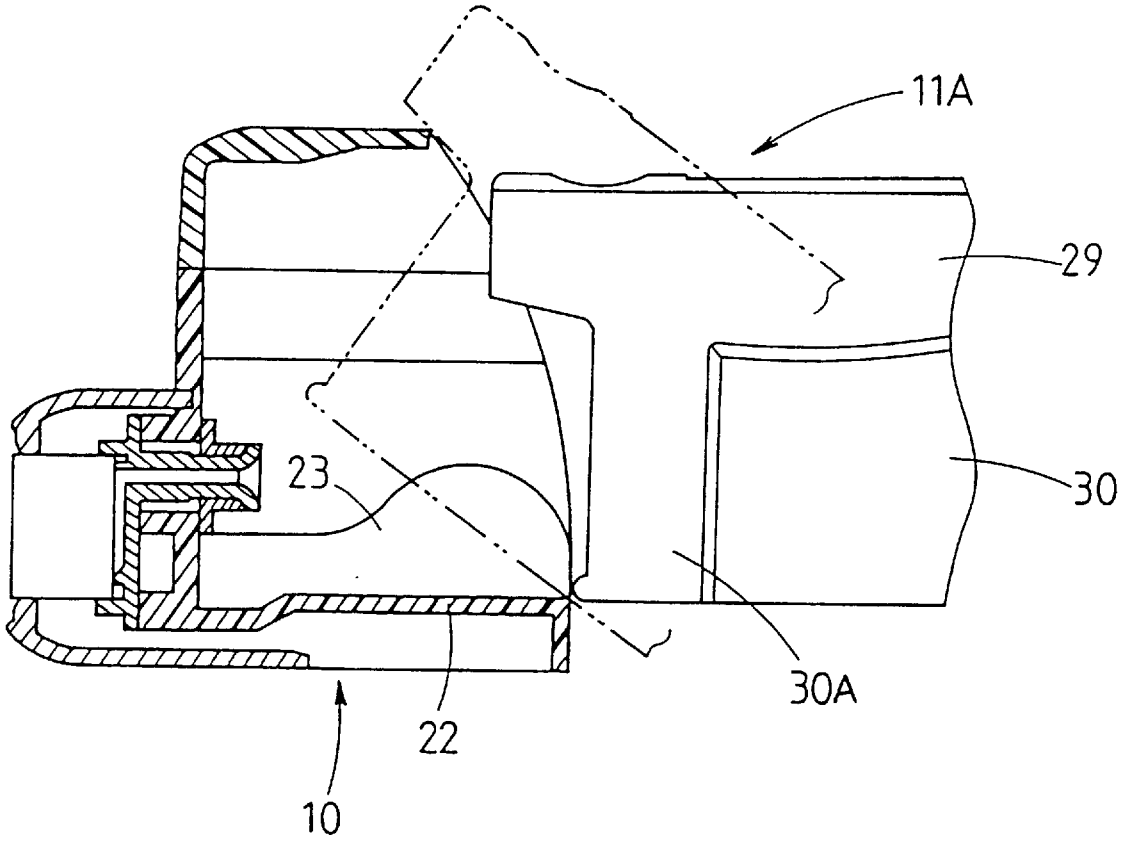
FIG. 12 is a schematic diagram showing an attempted mounting of the ink cartridge shown in FIG. 11 on the head holder when reversed.
Figure 13:
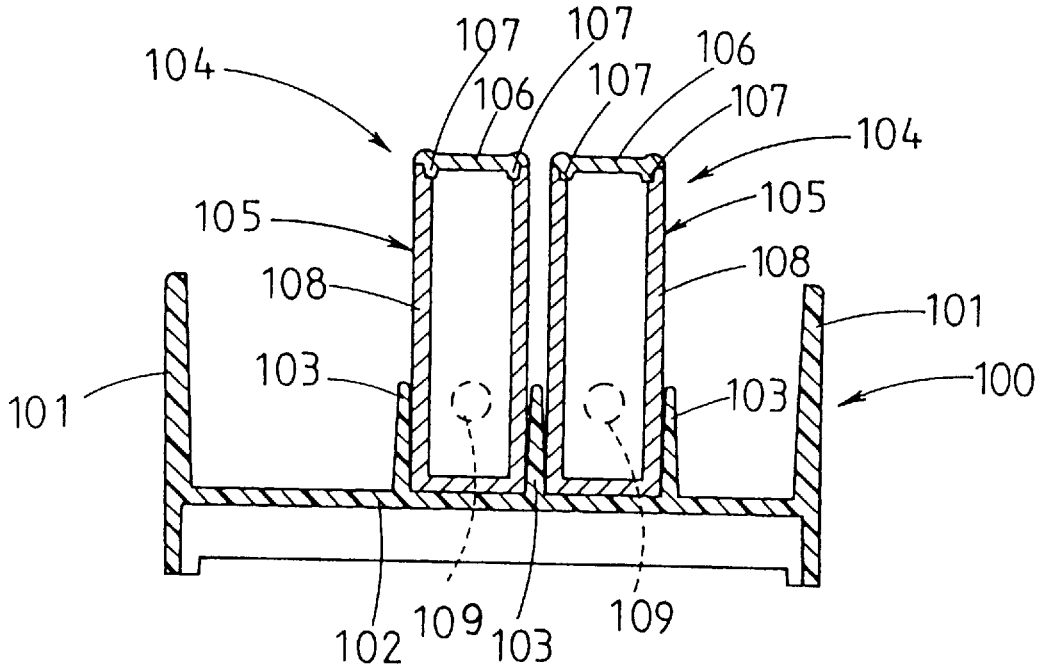
Fig.13 PRIOR ART
FIG. 13 is a cross-sectional view of a conventional ink cartridge which is mounted on a head holder.

Still further, according to a fifth embodiment, shown in FIGS. 11 and 12, a pair of side walls of a portion at the rear side of the lower portion of each ink cartridge 11, that is, a portion 30A located at the rear side of the partition walls 23, may be formed to be wider outwardly so that the width of the portion 30A is substantially equal to (is not necessary to be equal to) the width L1 of the upper portion 29. With this structure, as is apparent from FIG. 12, the ink cartridge 11 can be prevented from being mounted on the head holder 10 even when the ink cartridge 11 is mounted with its front and rear portions being inverted to each other. In this case, no projection portion functioning as a grasp member is provided at the upper portion of the rear surface of the cartridge 11. In the case where no projection portion functioning as a grasp member is provided, or a short projection portion is provided, the rear surface wall of the cartridge 11 which is being mounted with its front and rear portion being inverted may abut against the mesh filter 27 secured to the tip of the ink supply member 26 and damage the mesh filter 27. However, the above can be effectively prevented by the structure of the fifth embodiment.

What is claimed is:

1. An ink cartridge which is detachably mounted on a head, comprising:

an ink tank having a shape defined by two opposing side walls, two opposing end walls connecting the side walls and a base wall joining the side walls and the end walls to define an ink housing having an opening opposite the base wall, wherein at least one side wall of the two side walls has a first portion and a second portion, a distance between outer surfaces of the first portion of the at least one side wall and the other side wall of the two side walls defines a first width and a distance between outer surfaces of the second portion of the at least one side wall and the other side wall of the two side wall defines a second width different from the first width, the first portion and the second portion of the at least one side wall being one above the other between the base wall and the opening of the ink tank; and a lid member adhesively attached to a peripheral edge of the two side walls and the two end walls at the opening and serving to close said ink tank, wherein the first width of said ink tank is adjacent the opening and is larger than that of the second width adjacent the base wall, and a thickness of the at least one side wall is smaller at the second portion having the second width.

2.The ink cartridge as claimed in claim 1, wherein inner wall surfaces of the two side walls flat.

3. The ink cartridge as claimed in claim 1, wherein said lid is adhered to said ink tank by a shear weld.

4. The ink cartridge as claimed in claim 2, wherein said lid adhered to said ink tank by a shear weld.

5. An ink cartridge that is removably mounted to a print head, comprising:

a body having five contiguous sides including a base side, and extending from the base side, a print end side, an opposite end side opposing the print end side, a first lateral side and a second lateral side, the first lateral side opposing the second lateral side and both the first lateral side and the second lateral side extending between the print end side and the opposite end side to define an ink tank with an open sixth side; and a cover side mounted to peripheral edges of the print end side, the opposite end side, the first lateral side, and the second lateral side that demark the open sixth side to complete the ink tank, wherein each of the first lateral side and second lateral side have a first portion and a second portion, a first distance from an outer surface of the first portion of the first lateral side to an outer surface of the first portion of the second lateral side is greater than a second distance from an outer surface of the second portion of the first lateral side to the outer surface of the second portion of the second lateral side, the first portion and the second portion being one above the other between the base side and the open sixth side, the first portion of at least one of the first lateral side and the second lateral side has a greater wall thickness than the second portion.

6. The ink cartridge as claimed in claim 5, wherein the first distance is adjacent to the cover side.

7. The ink cartridge as claimed in claim 5, further comprising a print opening in the print end side.

8.The ink cartridge as claimed in claim 5, wherein an inner surface of at least one of the first lateral side and the second lateral side defines a plane.

9. The ink cartridge as claimed in claim 5, wherein an inner surface of the first lateral side is parallel to an outer surface of the first lateral side and an inner surface of the second lateral side is parallel to an outer surface of the second lateral side.

10. The ink cartridge as claimed in claim 5, wherein the peripheral edges of the print end side, the opposite end side, the first lateral side and the second lateral side that demark the sixth open side have a stepped wall and the cover side has a stepped peripheral edge to correspond to and complimentary to the stepped wall for joining the cover side to the print end side, the opposite end side, the first lateral side and the second lateral side.

11. The ink cartridge as claimed in claim 5, wherein said body further comprises a semi-circular projection which projects from the opposite end side of the body to engage the print head.

12. An ink printing device, comprising:

a carriage;

a head holder mounted to the carriage;

an ink jet head mounted to the head holder; and an ink cartridge removably mounted to the ink jet holder to engage with the ink jet head, wherein the head holder has a pair of substantially parallel lateral walls and the ink cartridge is provided with means for ensuring it can only be mounted to engage with the ink jet head, the ink cartridge also having substantially parallel walls, each substantially parallel wall having a first portion and a second portion, a first width between outside surfaces of the first portion of the substantially parallel walls of the ink cartridge different from a second width between outside surfaces of the second portion of the substantially parallel walls of the ink cartridge, wherein the difference in the first width and the second width allows the portion of the ink cartridge having a greater width to extend at least partially over at least one lateral wall to provide increases at least one of capacity of ink or decrease head holder size.

13. The ink printing device as claimed in claim 12, the head holder further comprising, intermediate the lateral walls, at least one partition wall, spacings defined by the lateral walls and the at least one partition wall providing ink cartridge receptacles.

14. An ink cartridge which is detachably mounted to a print head, comprising:

a cap;

a tank body having a peripheral wall surrounding a hollow interior, an open end and a wall at a closed end, the peripheral wall extends from the closed end to the open end, wherein a longitudinal cross section of the tank body has a first portion and a second portion, both the first and the second portion having a rectangular shape, a width of the first portion different than a width of the second portion, wherein the peripheral wall has a greater thickness at the open end, to which the cap is attached, than at the closed end.

15. The ink cartridge according to claim 14, further comprising a cover, wherein the open end of the tank body is sealably closed by the cover.

16. The ink cartridge according to claim 15, wherein the first portion of the longitudinal cross section has a greater width than the second portion of the longitudinal cross section.

* * * * *